US008998523B1

(12) United States Patent
Muller

(10) Patent No.: US 8,998,523 B1
(45) Date of Patent: Apr. 7, 2015

(54) CREAM DISPENSING APPLICATOR ASSEMBLY

(71) Applicant: Barbara J. Muller, Toronto (CA)

(72) Inventor: Barbara J. Muller, Toronto (CA)

( * ) Notice: Subject to any disclaimer, the term of this patent is extended or adjusted under 35 U.S.C. 154(b) by 150 days.

(21) Appl. No.: 13/761,367

(22) Filed: Feb. 7, 2013

(51) Int. Cl.
*A46B 5/02* (2006.01)
*A45D 40/26* (2006.01)

(52) U.S. Cl.
CPC ..... *A45D 40/262* (2013.01)

(58) Field of Classification Search
USPC ..... 401/6, 171, 172, 174, 175, 282, 196, 401/205, 207
See application file for complete search history.

(56) References Cited

U.S. PATENT DOCUMENTS 2,997,078 A * 8/1961 Gainer ..... 141/383
4,269,207 A * 5/1981 Konrad et al. ..... 132/308
4,622,984 A * 11/1986 Gaebel ..... 132/308
5,382,106 A * 1/1995 Voigt ..... 401/155
5,573,342 A 11/1996 Patalano
5,931,591 A 8/1999 McCracken
6,129,469 A 10/2000 Messer et al.
6,210,057 B1 4/2001 Yannaci et al.
6,247,862 B1 6/2001 Garza
6,261,014 B1 7/2001 Altobellis et al.
6,543,954 B2 4/2003 Owings
D493,569 S 7/2004 Angeletta
7,040,830 B2 5/2006 Kliegman et al.

* cited by examiner

*Primary Examiner* — David Walczak

(57) ABSTRACT

A cream dispensing applicator assembly allows an individual to easily, evenly, and cleanly apply cream to hard-to-reach areas of the body. The assembly includes an elongated member having a head coupled to a handle. The elongated member has an interior space configured for holding a liquid. A pad is coupled to the head. A channel extends through the head. A plurality of outlet ports is coupled to the pad and to the channel. A plunger, a shaft, a knob, and a switch are coupled to the handle. The shaft is coupled to and extends through the plunger. The knob is operationally coupled to the plunger wherein manipulation of the knob urges the plunger into the shaft. A valve is coupled to the handle and to the channel. The switch is operationally coupled to the valve wherein manipulation of the switch selectively opens and closes the valve.

14 Claims, 5 Drawing Sheets

CREAM DISPENSING APPLICATOR ASSEMBLY

BACKGROUND OF THE DISCLOSURE

Field of the Disclosure

The disclosure relates to applicator assemblies and more particularly pertains to a new applicator assembly for allowing an individual to easily, evenly, and cleanly apply cream to hard-to-reach areas of the individual's body.

SUMMARY OF THE DISCLOSURE

An embodiment of the disclosure meets the needs presented above by generally comprising an elongated member having a head coupled to a handle. The elongated member has an interior space configured for holding a liquid. A pad is coupled to the head. A channel extends through the head. A plurality of outlet ports is coupled to the pad and to the channel. A plunger, a shaft, a knob, and a switch are coupled to the handle. The shaft is coupled to and extends through the plunger. The knob is operationally coupled to the plunger wherein manipulation of the knob urges the plunger into the shaft. A valve is coupled to the handle and to the channel. The switch is operationally coupled to the valve wherein manipulation of the switch selectively opens and closes the valve.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
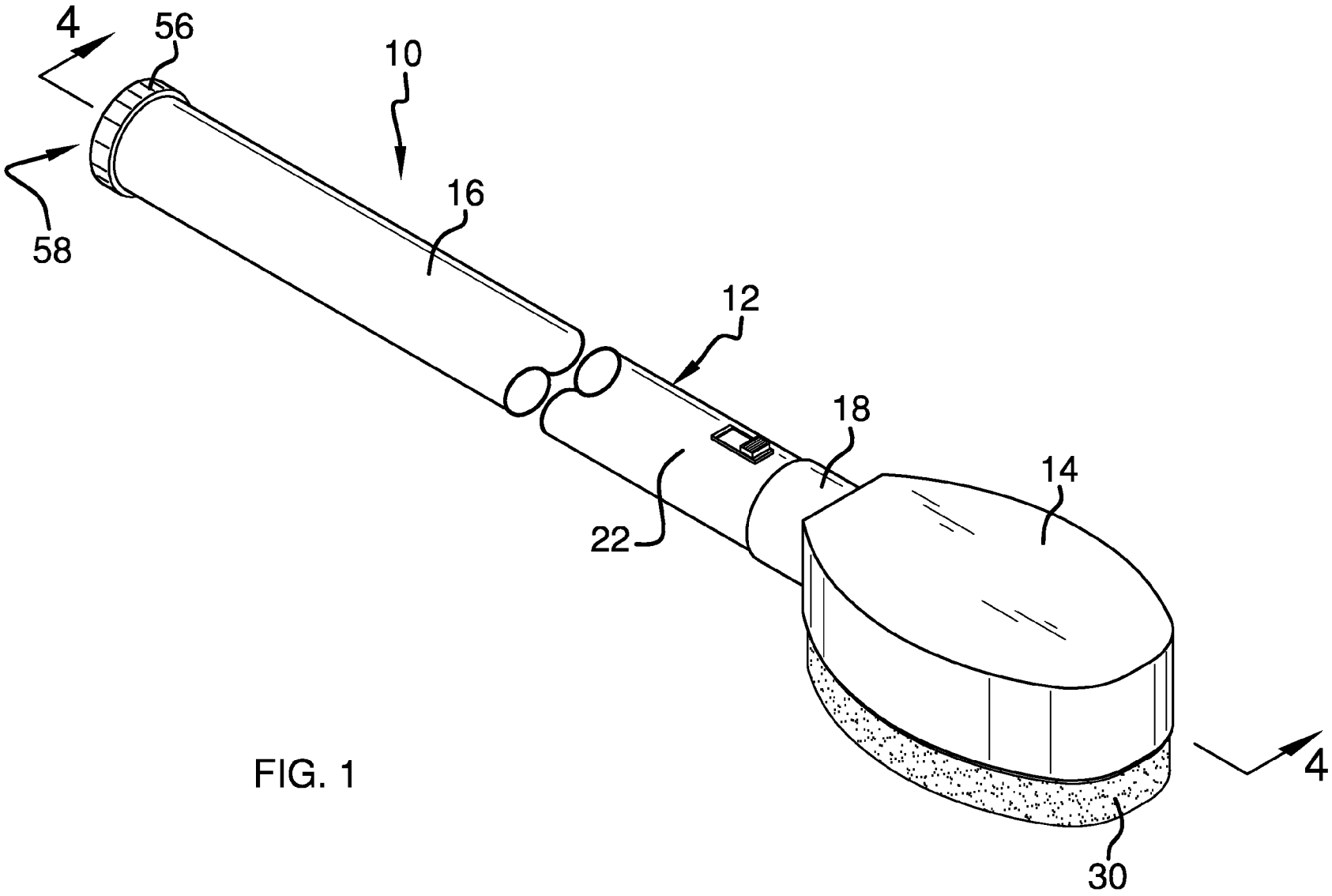
FIG. 1 is a bottom front side perspective view of a cream dispensing applicator assembly according to an embodiment of the disclosure.
Figure 2:
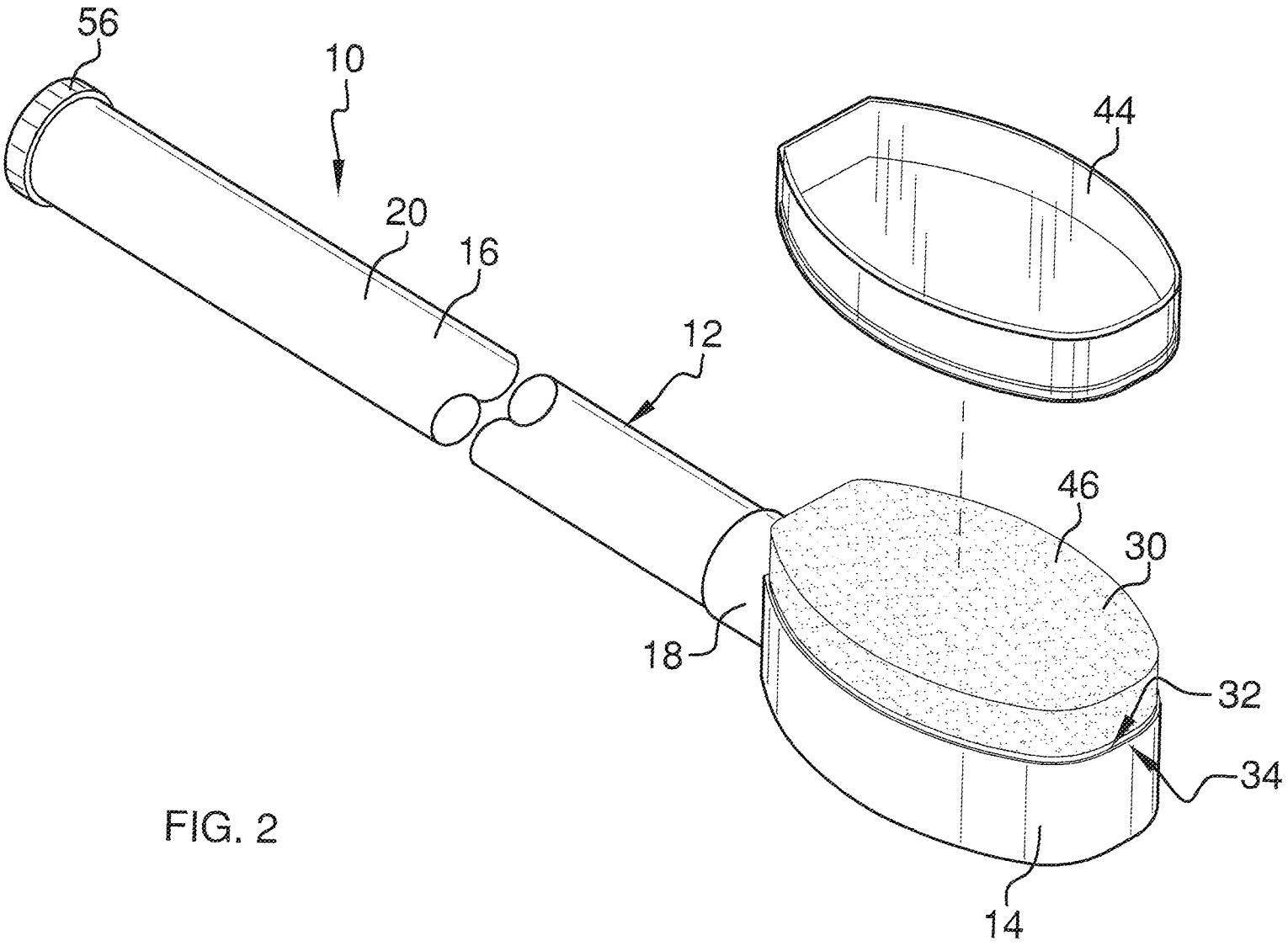
FIG. 2 is a partially-exploded top front side perspective view of an embodiment of the disclosure.
Figure 3:
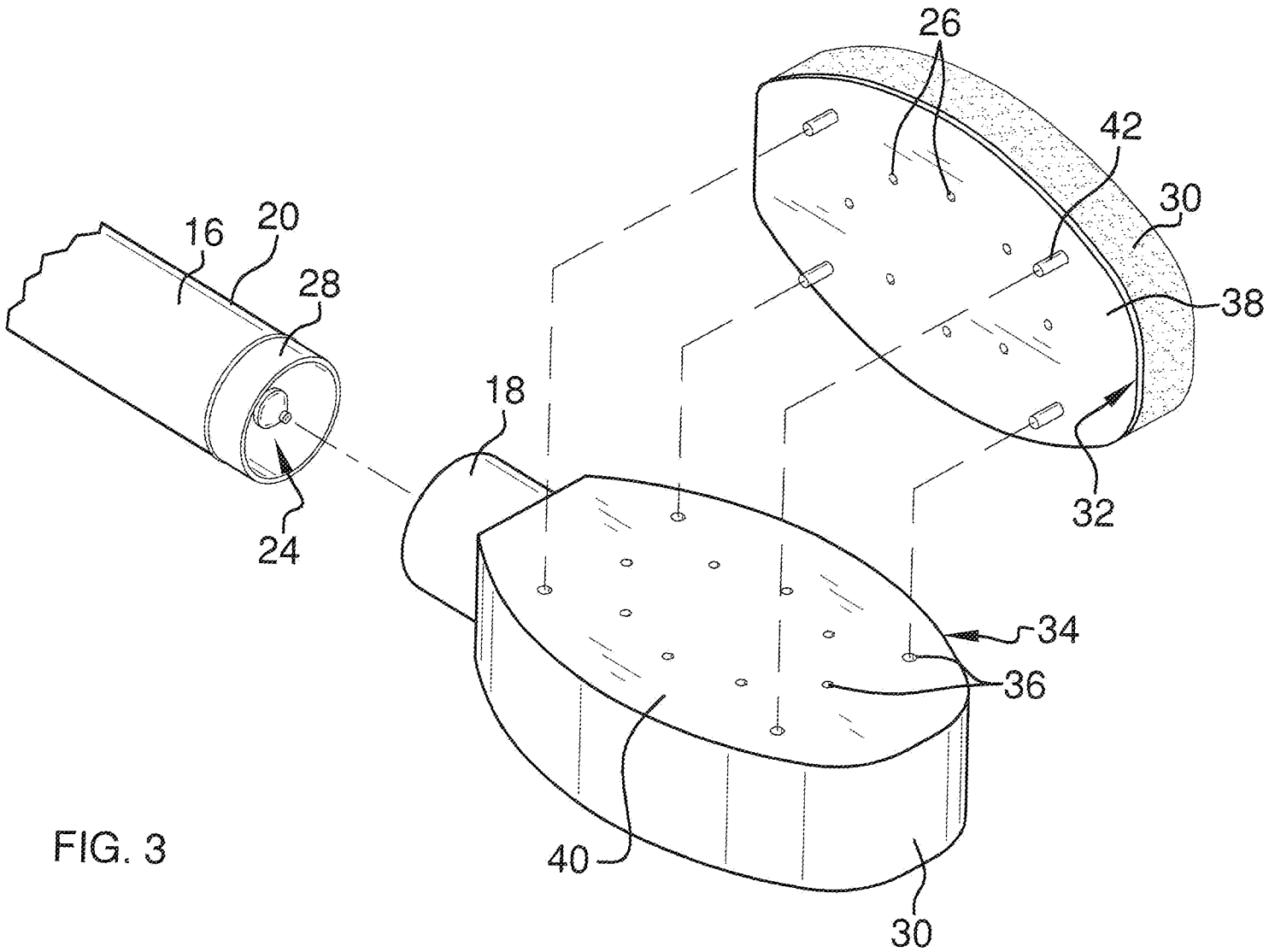
FIG. 3 is a partially-exploded top front side perspective view of an embodiment of the disclosure.
Figure 4:
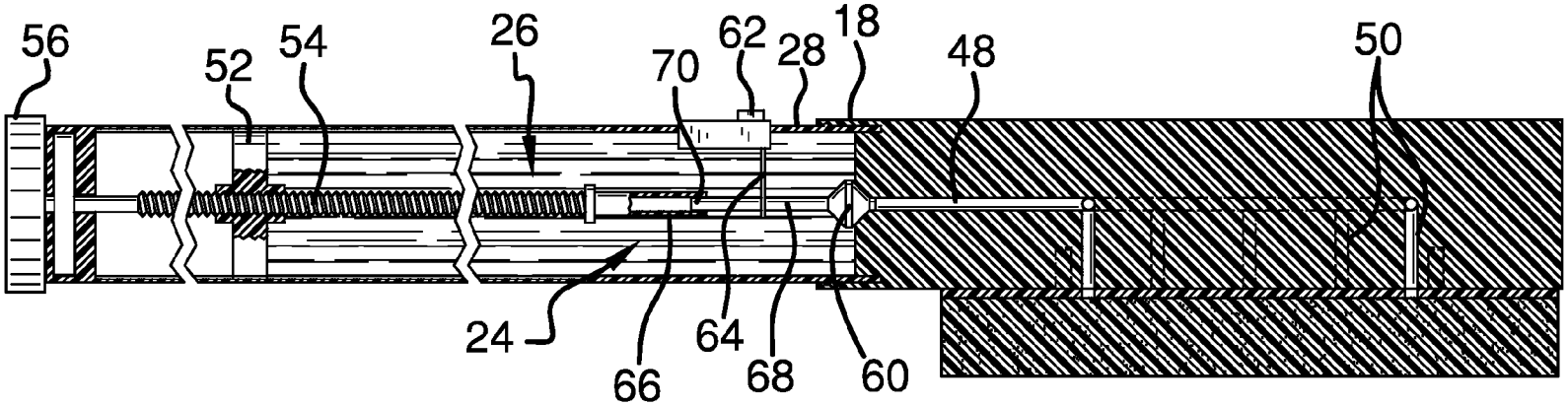
FIG. 4 is a cross-sectional view of an embodiment of the disclosure taken along line 4-4 of FIG. 1 and shows the valve being closed.
Figure 5:
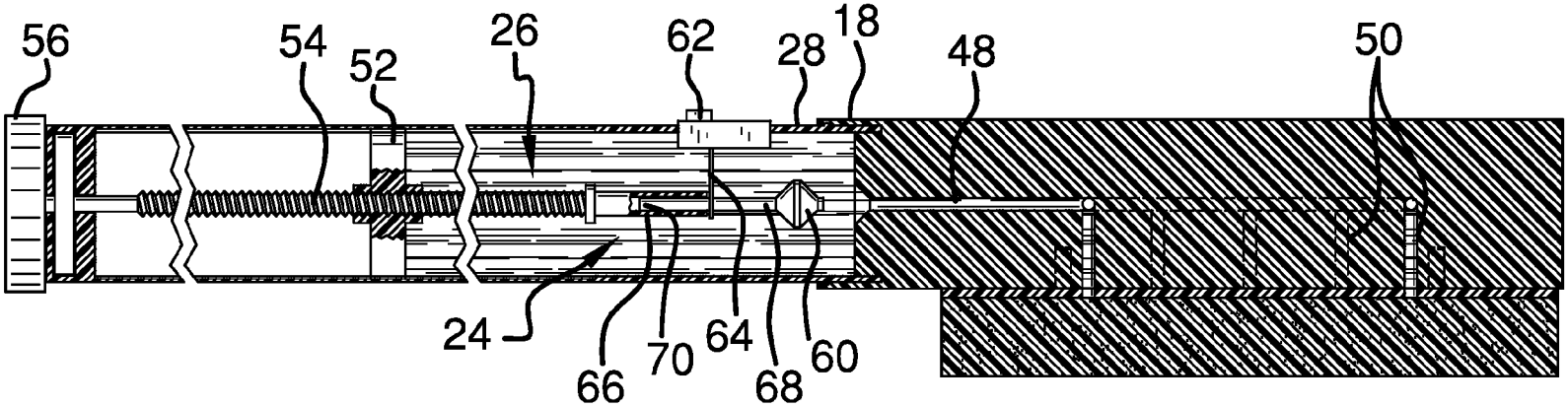
FIG. 5 is a cross-sectional view of an embodiment of the disclosure similar to FIG. 4 but instead shows the valve being open.
Figure 6:
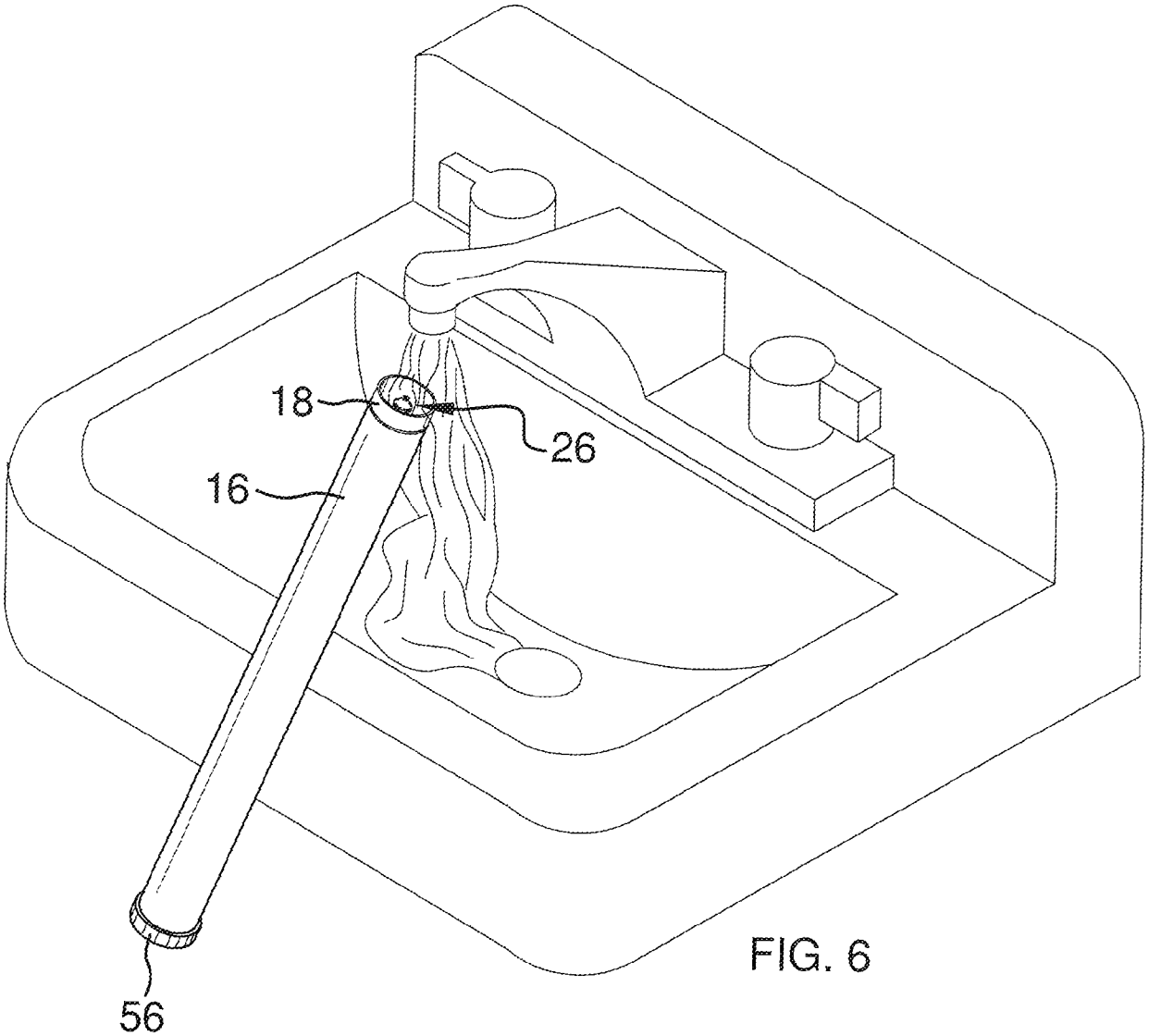
FIG. 6 is a top front side perspective view of an embodiment of the disclosure in use.

With reference now to the drawings, and in particular to FIGS. 1 through 6 thereof, a new applicator assembly embodying the principles and concepts of an embodiment of the disclosure and generally designated by the reference numeral 10 will be described.

As best illustrated in FIGS. 1 through 6, the cream dispensing applicator assembly 10 generally comprises an elongated member 12 having a head 14, a handle 16, and a neck 18 extending between the head 14 and the handle 16. The handle 16 is removably coupled to the neck 18. The handle 14 is telescopic wherein a length of the handle 14 is adjustable. A top side 20 and a bottom side 22 of the elongated member 12 define an interior space 24 configured for holding a liquid 26. A coupler 28 couples the handle 16 to the neck 18. The coupler 28 is configured to detach from the neck 18 such that the interior space 24 of the handle 16 can be cleaned.

A pad 30 is coupled to the head 14. The pad 30 is configured to apply liquid 26 to a user's body when the liquid 26 is dispensed through the pad 30 and the pad 30 is rubbed onto the user's body. The pad 30 allows a user to apply the liquid 26 cleanly as the hands of the user do not come in contact with the liquid 26. The liquid 26 may be lotion, sunscreen, moisturizer, or a similar cream or liquid. The easy and even application that the pad 30 provides may help reduce the incidence of sunburn and skin cancer. The pad 30 allows a user to apply liquid 26 to hard-to-reach areas on the body, such as the middle back area. The pad 30 can be rinsed after use as desired or replacement pads 30 may be purchased. The pad 30 is preferably soft and absorbent. The pad 30 may be round or oval-shaped. The pad 30 has a shape and size corresponding to the head 14 such that an outer perimeter edge 32 of the pad 30 aligns with an outer perimeter edge 34 of the head 14 when the pad 30 is coupled to the head 14. A plurality of locking holes 36 is positioned in the head 14. The locking holes 36 are positioned in a top side 40 of the head 14. A plurality of locking pins 42 is coupled to the pad 30. The locking pins 42 extend outwardly from the bottom side 38 of the pad 30 wherein the locking pins 42 are configured to couple the pad 30 to the head 14 when the locking pins 42 are selectively inserted through the locking holes 36. A cover 44 is coupled to the pad 30. The cover 44 is selectively couplable to the pad 30 wherein the cover 44 is configured to protect the pad 30 when the cover 44 is coupled to a top side 46 of the pad 30. The cover 44 snaps onto the pad 30 and may be used during storage and transport. A channel 48 extends longitudinally through the head 14 wherein the channel 48 is configured to guide the liquid 26 through the head 14. A plurality of outlet ports 50 is coupled to the pad 30 and to the channel 48. The outlet ports 50 are configured for dispensing liquid 26 from the channel 48 through the top side 46 of the pad 30. The outlet ports 50 are spaced and positioned perpendicular to the channel 48.

A plunger 52 is coupled to the handle 16. The plunger 52 extends through the interior space 24 of the handle 16. A shaft 54 is coupled to the handle 16. The shaft 54 extends through the interior space 24 of the handle 16. The shaft 54 is coupled to and extends through the plunger 52. The shaft 54 has a length between approximately 25 centimeters and 65 centimeters. The shaft 54 is preferably made from plastic. The shaft 54 is preferably a corkscrew style mechanism. A knob 56 is coupled to the handle 16. The knob 56 is operationally coupled to the plunger 52 wherein manipulation of the knob 56 urges the shaft 54 to move the plunger 52. The knob 56 is circular and extends a full length around a bottom end 58 of the handle 16.

A valve 60 is coupled to the handle 16 and to the channel 48. The valve 60 extends through the interior space 24 of the handle 16. A switch 62 is coupled to the handle 16. The switch 62 is operationally coupled to the valve 60 wherein manipulation of the switch 62 selectively opens and closes the valve 60 wherein the channel 48 is configured to receive the liquid 26 when the valve 60 is open and the handle 16 is configured to retain the liquid 26 when the valve 60 is closed. The valve 60 can stop the flow of liquid 26 and help prevent the liquid 26 from leaking. A lever 64 is coupled to the handle 16. The lever 64 is operationally coupled to the switch 62 wherein manipulation of the switch 62 simultaneously moves the lever 64 with the switch 62. The lever 64 extends downwardly from the switch 62. A sleeve 66 is coupled to the handle 16. The sleeve 66 extends through the interior space 24 of the handle 16. The sleeve 66 is coupled to the shaft 54 and is configured to stabilize the valve 60. A valve shaft 68 is coupled to the handle 16. A first end 70 of the valve shaft 68 is selectively insertable into the sleeve 66 when the valve 60 is open. The first end 70 of the valve shaft 68 is coupled to the lever 64 when the valve 60 is closed.

In use, as stated above and shown in the Figures, a desired amount of liquid 26 is poured into the interior space 24 of the handle 16. Liquid 26 moves through the handle 16 by turning the knob 56 which pushes the plunger 52 toward the pad 30. The switch 62 is manipulated to open the valve 60 and permit the flow of liquid 26 out onto the pad 30. The user holds the handle 16 and rubs the pad 30 over the desired location on the body. The user manipulates the switch 62 after use to close the valve 60 and stop liquid 26 from flowing out onto the pad 30. The pad 30 is then cleaned or replaced as desired.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A cream dispensing applicator assembly comprising:

an elongated member having a head coupled to a handle, a top side and a bottom side of said elongated member defining an interior space configured for holding a liquid;

a pad coupled to said head, said pad being configured to apply liquid to a user's body when the liquid is dispensed through said pad and said pad is rubbed onto the user's body;

a channel extending through said head wherein said channel is configured to guide the liquid through said head;

a plurality of outlet ports being coupled to said pad and to said channel, said outlet ports being configured for dispensing liquid from said channel through a top side of said pad;

a plunger coupled to said handle;

a shaft coupled to said handle, said shaft being coupled to and extending through said plunger;

a knob coupled to said handle at an end of said handle opposite said head, said knob being operationally coupled to said plunger wherein manipulation of said knob urges said shaft to move said plunger wherein said plunger is configured for urging the liquid into said head;

a valve being coupled to said handle and to said channel between said handle and said head; and a switch coupled to said handle, said switch being positioned on said handle in spaced relationship to said knob, said switch being operationally coupled to said valve wherein manipulation of said switch selectively opens and closes said valve wherein said channel is configured to receive the liquid when said valve is open and said handle is configured to retain the liquid when said valve is closed.

2. The assembly of claim 1, further comprising said elongated member having a neck extending between said head and said handle wherein said handle is removably coupled to said neck.

3. The assembly of claim 2, further comprising a coupler coupling said handle to said neck, said coupler being configured to detach from said neck for cleaning of said interior space.

4. The assembly of claim 1, further comprising said handle being telescopic wherein a length of said handle is adjustable.

5. The assembly of claim 1, further comprising said pad having a shape and size corresponding to said head such that an outer perimeter edge of said pad aligns with an outer perimeter edge of said head when said pad is coupled to said head.

6. The assembly of claim 1, further comprising a cover coupled to said pad, said cover being selectively couplable to said pad wherein said cover is configured to protect said pad when said cover is coupled to a top side of said pad.

7. The assembly of claim 1, further comprising:

a plurality of locking holes being positioned in said head, said locking holes being positioned in a top side of said head; and a plurality of locking pins being coupled to said pad, said locking pins extending outwardly from said bottom side of said pad wherein said locking pins are configured to couple said pad to said head when said locking pins are selectively inserted through said locking holes.

8. The assembly of claim 1, further comprising said outlet ports being spaced and positioned perpendicular to said channel.

9. The assembly of claim 1, further comprising said knob being circular and extending a full length around a bottom end of said handle.

10. The assembly of claim 1, further comprising each of said plunger, shaft, and valve extending through said interior space of said handle.

11. The assembly of claim 1, further comprising a lever coupled to said handle, said lever being operationally coupled to said switch wherein manipulation of said switch simultaneously moves said lever with said switch.

12. The assembly of claim 1, further comprising a sleeve coupled to said handle and to said shaft, said sleeve extending through said interior space of said handle and being configured to stabilize said valve.

13. The assembly of claim 12, further comprising a valve shaft being coupled to said handle, a first end of said valve shaft being selectively insertable into said sleeve when said valve is open, said first end of said valve shaft being coupled to said lever when said valve is closed.

14. A cream dispensing applicator assembly comprising:

an elongated member having a head, a handle, and a neck extending between said head and said handle, said handle being removably coupled to said neck, said handle being telescopic wherein a length of said handle is adjustable, a top side and a bottom side of said elongated member defining an interior space configured for holding a liquid;

a coupler couples said handle to said neck, said coupler being configured to detach from said neck for cleaning of said interior space;

a pad coupled to said head, said pad being configured to apply liquid to a user's body when the liquid is dispensed through said pad and said pad is rubbed onto the user's body, said pad having a shape and size corresponding to said head such that an outer perimeter edge of said pad aligns with an outer perimeter edge of said head when said pad is coupled to said head;

a plurality of locking holes being positioned in said head, said locking holes being positioned in a top side of said head;

a plurality of locking pins being coupled to said pad, said locking pins extending outwardly from said bottom side of said pad wherein said locking pins are configured to couple said pad to said head when said locking pins are selectively inserted through said locking holes;

a cover coupled to said pad, said cover being selectively couplable to said pad wherein said cover is configured to protect said pad when said cover is coupled to a top side of said pad;

a channel extending longitudinally through said head wherein said channel is configured to guide the liquid through said head;

a plurality of outlet ports being coupled to said pad and to said channel, said outlet ports being configured for dispensing liquid from said channel through said top side of said pad, said outlet ports being spaced and positioned perpendicular to said channel;

a plunger coupled to said handle, said plunger extending through said interior space of said handle;

a shaft being coupled to said handle, said shaft extending through said interior space of said handle, said shaft being coupled to and extending through said plunger;

a knob coupled to said handle at an end of said handle opposite said head, said knob being operationally coupled to said plunger wherein manipulation of said knob urges said shaft to move said plunger wherein said plunger is configured for urging the liquid into said head, said knob being circular and extending a full length around a bottom end of said handle;

a valve being coupled to said handle and to said channel between said handle and said head, said valve extending through said interior space of said handle;

a switch coupled to said handle, said switch being positioned on said handle in spaced relationship to said knob, said switch being operationally coupled to said valve wherein manipulation of said switch selectively opens and closes said valve wherein said channel is configured to receive the liquid when said valve is open and said handle is configured to retain the liquid when said valve is closed;

a lever coupled to said handle, said lever being operationally coupled to said switch wherein manipulation of said switch simultaneously moves said lever with said switch, said lever extending downwardly from said switch;

a sleeve coupled to said handle and to said shaft, said sleeve extending through said interior space of said handle and being configured to stabilize said valve; and a valve shaft being coupled to said handle, a first end of said valve shaft being selectively insertable into said sleeve when said valve is open, said first end of said valve shaft being coupled to said lever when said valve is closed.

* * * * *